US009844864B2

(12) United States Patent
Zhao et al.

(10) Patent No.: US 9,844,864 B2
(45) **Date of Patent: *Dec. 19, 2017**

(54) SLEEVE FOR A PNEUMATIC FASTENER-DRIVING TOOL

(75) Inventors: Hanxin Zhao, Northbrook, IL (US); Stephen P. Moore, Carpentersville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 580 days.

This patent is subject to a terminal disclaimer.

(21) Appl. No.: 13/370,393

(22) Filed: Feb. 10, 2012

(65) Prior Publication Data

US 2013/0206811 A1 Aug. 15, 2013

(51) Int. Cl.
*B25C 1/04* (2006.01)

(52) U.S. Cl.
CPC ..... *B25C 1/041* (2013.01)

(58) Field of Classification Search
CPC B25C 1/047; B25C 1/045; B25C 1/04; B25C 1/044; B25F 5/006; B25D 9/20
USPC ..... 227/9, 10, 130
See application file for complete search history.

(56) References Cited

U.S. PATENT DOCUMENTS

| | | | |
|---|---|---|---|
| 3,042,008 | A | 7/1962 | Liesse |
| 3,438,449 | A | 4/1969 | Smith |
| 3,567,098 | A | 3/1971 | Maynard |
| RE27,207 | E | 10/1971 | Ramspeck |
| 3,638,532 | A | 2/1972 | Novak |
| 4,717,060 | A | 1/1988 | Cotta |
| 4,739,915 | A | 4/1988 | Cotta |
| 5,558,264 | A | 9/1996 | Weinstein |
| 5,671,880 | A | 9/1997 | Ronconi |

(Continued)

FOREIGN PATENT DOCUMENTS

| | | |
|---|---|---|
| EP | 1 914 041 | 4/2008 |
| JP | 2000334675 | 12/2000 |

(Continued)

OTHER PUBLICATIONS

International Search Report and Written Opinion for International Application No. PCT/US2013/025102, dated Sep. 25, 2013 (10 pages).

(Continued)

*Primary Examiner* — Andrew M Tecco
*Assistant Examiner* — Chelsea Stinson
(74) *Attorney, Agent, or Firm* — Neal, Gerber & Eisenberg LLP

(57) ABSTRACT

A fastener driving tool including a housing enclosing a cylinder having a lower end with a resilient bumper, a return air chamber in communication with the lower end of the cylinder and a piston dimensioned for reciprocation within the cylinder to impact the bumper and having a driver blade depending therefrom. At least one inlet opening is in communication with the return air chamber and at least one outlet opening is disposed in the cylinder and spaced from the at least one inlet opening. The at least outlet opening is in communication with the return air chamber and aligned with the piston so that each outlet opening is closed by the piston to seal the cylinder as the piston impacts the bumper and traps a residual volume of air in the cylinder below the piston to damp impact of the piston upon the bumper.

13 Claims, 6 Drawing Sheets

(56) References Cited

U.S. PATENT DOCUMENTS

| | | | | |
|---|---|---|---|---|
| 6,016,945 | A | 1/2000 | Phillips et al. | |
| 6,095,392 | A | 8/2000 | Batts, Jr. et al. | |
| 6,145,727 | A | 11/2000 | Mukoyama et al. | |
| 6,260,519 | B1 | 7/2001 | Phillips | |
| 7,040,521 | B2 | 5/2006 | Kolodziej et al. | |
| 7,063,052 | B2 | 6/2006 | Nishikawa et al. | |
| 7,063,053 | B2 | 6/2006 | Hirai et al. | |
| 7,201,301 | B2 | 4/2007 | Moeller et al. | |
| 7,210,431 | B2 | 5/2007 | Nishikawa et al. | |
| 7,314,025 | B2 | 1/2008 | Shkolnikov et al. | |
| 7,318,546 | B2 | 1/2008 | Segura et al. | |
| 7,377,413 | B2 * | 5/2008 | Wen | 227/8 |
| 7,451,903 | B2 * | 11/2008 | Aihara | B25C 1/042 227/130 |
| 7,591,236 | B2 * | 9/2009 | Moeller | B25C 1/08 123/46 SC |
| 7,677,426 | B2 * | 3/2010 | Tillinghast | B25C 1/043 227/10 |
| 7,918,375 | B2 | 4/2011 | Johnson et al. | |
| 8,016,046 | B2 * | 9/2011 | Zhao et al. | 173/1 |
| 2001/0009260 | A1 | 7/2001 | Ishizawa et al. | |
| 2005/0173486 | A1 * | 8/2005 | Moeller | B25C 1/08 227/10 |
| 2008/0023519 | A1 | 1/2008 | Aihara | |
| 2008/0169326 | A1 | 7/2008 | Moeller et al. | |
| 2010/0065602 | A1 * | 3/2010 | Zhao | B25C 1/08 227/9 |
| 2011/0068142 | A1 * | 3/2011 | Webb | B25D 9/10 227/10 |
| 2011/0198384 | A1 * | 8/2011 | Kitagawa | B25C 1/041 227/130 |

FOREIGN PATENT DOCUMENTS

| | | |
|---|---|---|
| WO | WO 2008/029901 | 3/2008 |
| WO | WO 2010/030453 | 3/2010 |

OTHER PUBLICATIONS

International Preliminary Report on Patentability for International Application No. PCT/US2013/025102, dated Aug. 12, 2014 (7 pages).

* cited by examiner

SLEEVE FOR A PNEUMATIC FASTENER-DRIVING TOOL

BACKGROUND

The present invention relates generally to fastener-driving tools used to drive fasteners into workpieces, and specifically to pneumatic-powered fastener-driving tools, also referred to as pneumatic tools or pneumatic nailers.

Fastening tools, and particularly those using compressed air as an energy source, incorporate a housing enclosing a cylinder. Slidably mounted within the cylinder is a piston assembly in communication on one side with a supply chamber and a return chamber on the opposite side thereof. The piston assembly includes a piston head and a rigid driver blade that is disposed within the cylinder. A movable valve plunger is oriented above the piston head. In its at-rest position this valve plunger prevents the drive chamber from communicating to the piston assembly and allows an air flow path to atmosphere above the piston assembly. In its actuated state, the valve plunger prevents or blocks the air flow path to atmosphere and allows an air flow path to the drive chamber When a tool's actuation requirements have been met, the movable valve plunger opens and exposes one side of the piston assembly to a compressed gas energy source. The resulting pressure differential causes the piston and driver blade to be actuated downward to impact a positioned fastener and drive it into a workpiece. Fasteners are fed into the nosepiece from a supply assembly, such as a magazine, where they are held in a properly positioned orientation for receiving the impact of the driver blade.

As the piston is actuated downward, it drives the air inside the cylinder through a series of vents into the return chamber increasing the pressure in this chamber. After the fastening event has taken place, the valve plunger moves back to the at-rest position, blocking the supply chamber's air flow path to the piston head and releasing the pressure above the piston head through the path to atmosphere. At this time, the pressure built in the return chamber pushes the piston assembly back up towards the top of the cylinder. The air above the piston head is forced through the valve plunger's air flow path to atmosphere.

The pressure available to drive the piston in pneumatic fastening tools varies based on the source. The variance in pressure causes fasteners to be driven to different depths in an underlying substrate or workpiece. Furthermore, the repeated, reciprocal motion of the piston and impact at the bottom of the cylinder reduces the working life of the tool.

SUMMARY

To overcome the above problems, the present fastener driving tool includes a cylinder or sleeve, and a piston movable within the cylinder where the cylinder and piston are configured to seal a volume of air at the bottom of the cylinder for reducing impact forces on the tool and improving the consistency of the driven depth of the fasteners.

In an embodiment, a fastener driving tool is provided and includes a housing enclosing a cylinder provided with a resilient bumper, a return air chamber in communication with the cylinder and a piston dimensioned for reciprocation within the cylinder to impact the bumper and having a driver blade depending therefrom. At least one inlet opening is disposed in the cylinder and in communication with the return air chamber and at least one outlet opening is disposed in the cylinder and spaced from the at least one inlet opening. The at least one outlet opening is in communication with the return air chamber and aligned with the piston so that each outlet opening is closed by the piston to seal the cylinder when the piston impacts the bumper and traps a residual volume of air in the sealed cylinder below the piston to damp impact of the piston upon the bumper.

In another embodiment, a fastener driving tool is provided and includes a cylinder provided with a resilient bumper, a return air chamber in communication with the cylinder and a piston dimensioned for reciprocation within the cylinder and having a driver blade depending therefrom, and a pair of spaced seal rings. A plurality of inlet openings are defined by the cylinder, where each of the inlet openings is in communication with the return air chamber. Also, a plurality of outlet openings are defined by the cylinder and spaced from the plurality of inlet openings. The plurality of outlet openings each having a height approximately less than or equal to a height of the piston, the piston configured to block each of the plurality of outlet openings to seal the cylinder when the piston impacts the bumper and retains a residual volume of air for providing damping to the piston. The plurality of outlet openings each having a height less than or equal to a distance between the rings so that at least one of an upper seal ring seals an upper margin of each of the plurality of outlet openings, and a lower seal ring seals a lower margin of each of the plurality of outlet openings when the piston impacts the bumper.

In a further embodiment, a method for generating a residual air volume in a pneumatic fastening tool is provided where the tool includes a cylinder provided with a resilient bumper, a piston dimensioned for reciprocation within the cylinder, a driver blade depending from the piston, and at least one outlet opening. The method includes positioning the at least one outlet opening to correspond with a position of the piston when it impacts the bumper, wherein each of the outlet openings is blocked by the piston to seal the cylinder upon the impact of the bumper; and reducing a volume defined between the piston and the lower end of the cylinder by increasing at least one of piston profile and bumper profile.

DETAILED DESCRIPTION

Figure 1:
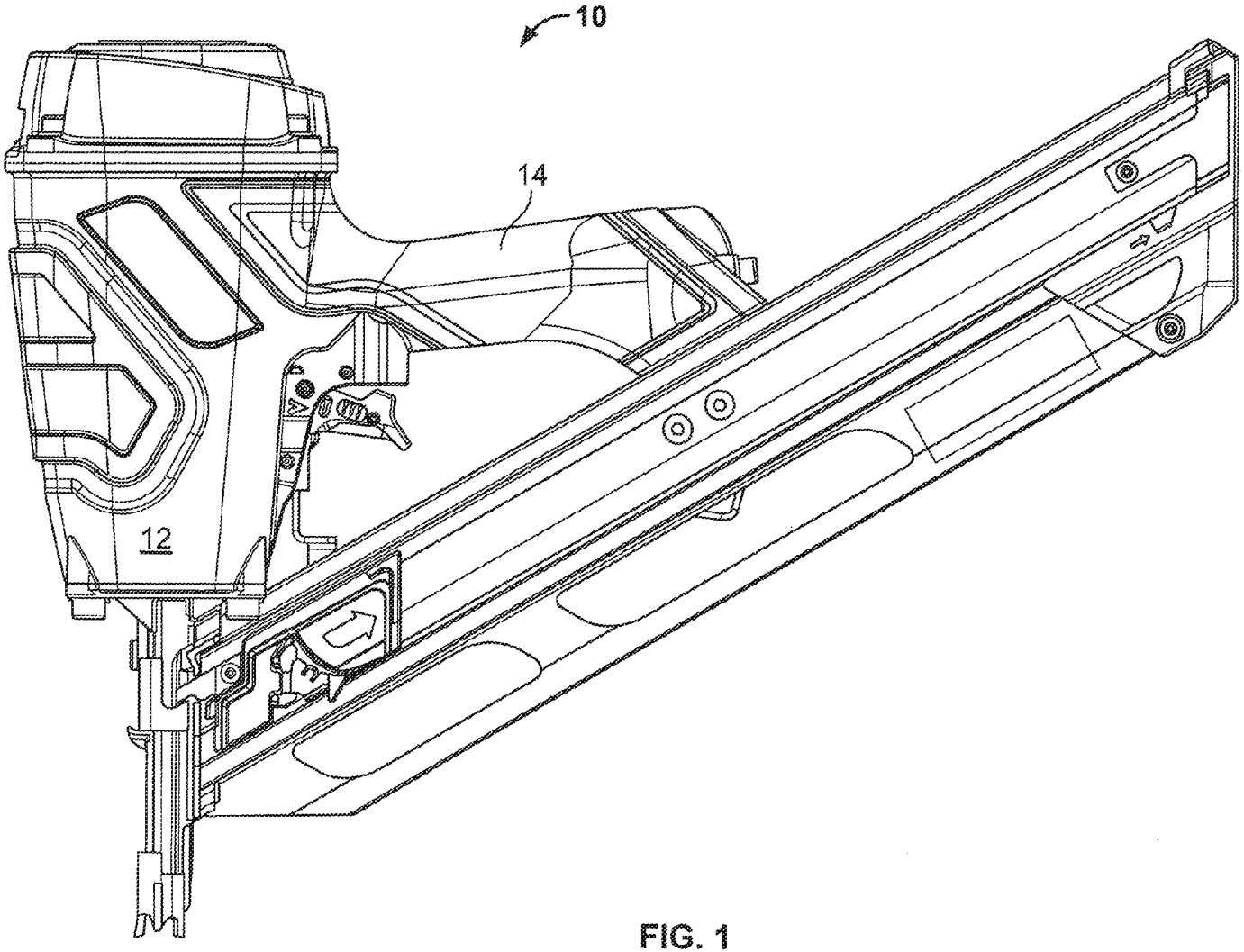
FIG. 1 is a perspective view of a pneumatic fastening tool.
Figure 2:
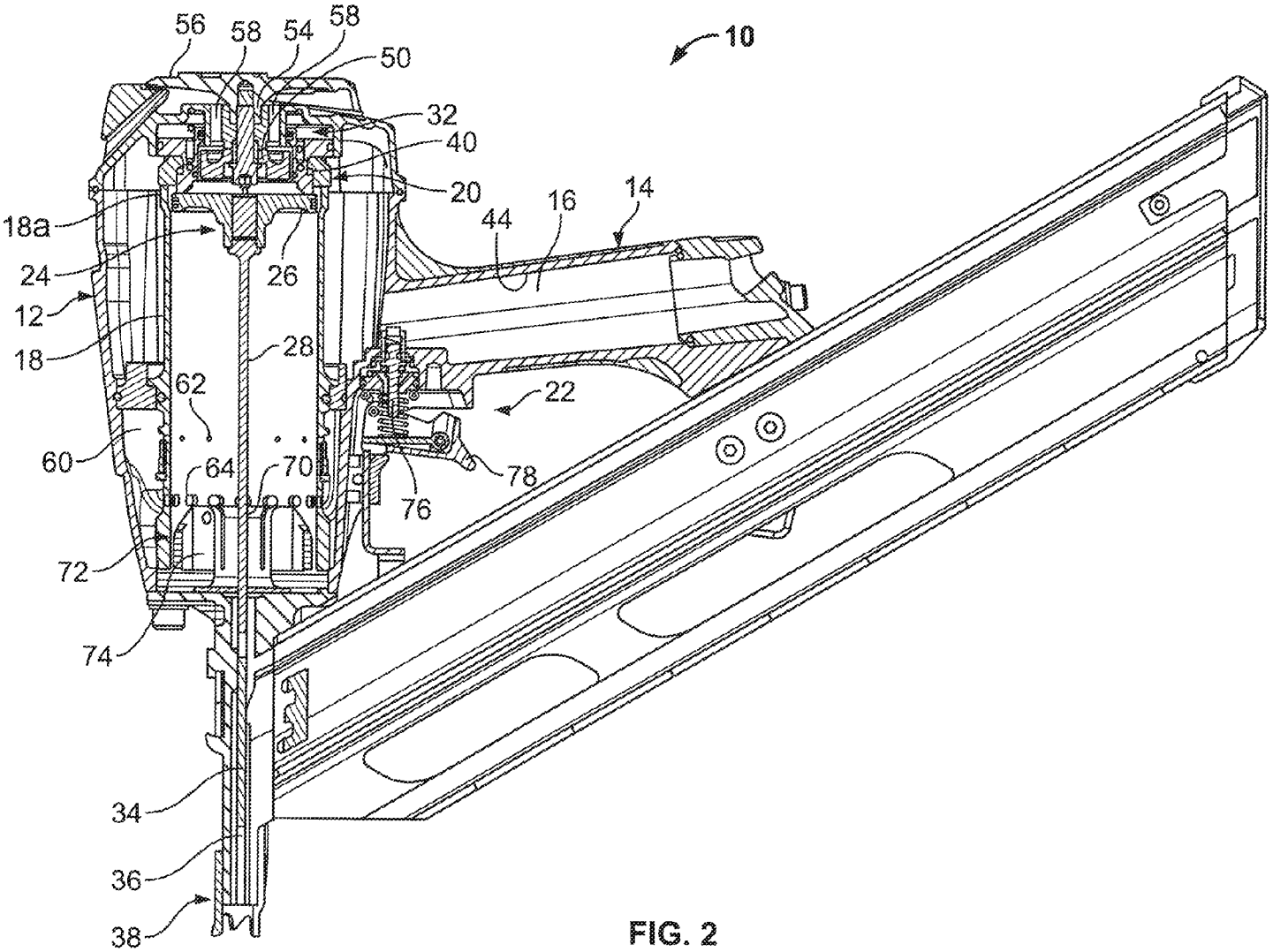
FIG. 2 is a fragmentary side vertical section of the present pneumatic fastening tool of FIG. 1.

Referring now to FIGS. 1 and 2, there is fragmentarily illustrated a fastener driving tool, generally illustrated as 10, which embodies the control valve assembly and bumper arrangement according to the present invention. The tool 10 may be of known construction, and, as illustrated, comprises a housing 12 including a generally vertically extending head or forward portion and a rearwardly extending hollow handle 14 having a cavity defining a fluid reservoir 16. Pressurized fluid, such as compressed air, is supplied to the fluid reservoir 16 of the tool by a suitable flexible line. The drive system for the tool 10 includes a main or power cylinder 18 mounted within the head portion of the housing 12 and having an open upper end 18*a* that is adapted to be selectively connected to the reservoir 16. The open upper end of the cylinder 18 is in engagement with a main or cylinder valve assembly 20 of a known type, under the control of a control valve assembly 22 according to the present invention. A fastener driving assembly 24 slidably mounted in the cylinder 18 includes a main or drive piston 26 and has connected thereto a depending drive blade member 28. The fastener driving assembly 24 is normally biased to a position with the piston 26 adjacent the cylinder valve assembly 20. An exhaust valve assembly indicated generally as 32 is provided for controlling the selective connection of the upper end 18*a* of the cylinder 18 to the atmosphere.

When the tool 10 is to be operated, compressed fluid from the reservoir 16 enters the upper open end 18*a* of the cylinder 18 and drives the fastener driving assembly 24 downwardly to engage and set a fastener or nail 34 supplied to a drive track 36 in a nosepiece or nosepiece structure 38. The flow of compressed fluid in the upper end of the cylinder 18 is controlled by the main valve assembly 20, which includes a vertically movable ring member 40 defining a valve element. The cylinder side of the ring member 40 is continuously in communication with the fluid reservoir 16 through a suitable passageway 44 so that pressurized fluid continuously acts against the cylinder side of the ring member 40 tending to displace the ring member 40 from the edge 18*a* of the cylinder 18. However pressurized fluid is also introduced to the opposite side of the ring member 40 through a passageway while the fastener driving tool 10 is in a static or at rest position. The differential pressure acting on the ring member 40 is effective to maintain the ring member 40 down, in a closed position. However, if the pressurized fluid above the ring member 40 is discharged, the pressurized fluid acting through the passageway 44 is effective to unseat the ring member 40 from the edge 18*a* of the cylinder 18 to dump pressurized fluid into the top of the main cylinder 18 and to drive the drive piston 26 through the drive stroke.

When the fastener driving tool 10 is at rest, or during the return stroke of the drive piston 26, the upper open end of the cylinder 18 is exhausted to the atmosphere through the exhaust valve assembly 32. In the illustrated embodiment, the exhaust valve assembly 32 includes a valve member 50 spaced below an inner surface of a downwardly projecting boss 54 defined in a cap 56 of the tool 10. The cap 56 has a plurality of exhaust passageways 58 providing for the exhaust of the fluid when the ring member 40 is in its downward position.

To provide for the return stroke of the fastener driving assembly 24, there is provided a return air chamber 60 communicating with the lower end of the cylinder 18 through a plurality of fluid inlet openings or ports 62 and a plurality of fluid outlet openings or ports 64. An annular band 63, made of rubber or other suitable material, is positioned on the periphery of the cylinder 18 and over the inlet ports 62. The band 63 includes a slit or other suitable closable opening that is aligned with each inlet port 62 so that the inlet ports each act as a one-way check valve that allows a pressurized fluid, such as pressurized air, to flow through the inlet ports into the return air chamber 60 but not from the return air chamber to the cylinder. The cylinder 18 includes a pair of spaced annular protrusions 65 that are positioned adjacent to each end of the band 63 to help secure the band's position on the cylinder. The outlet ports 64 are generally larger in size than the inlet ports 62 and are configured to allow air to flow between the cylinder 18 and the return air chamber 60.

Thus it will be understood that in the normal operation of the fastener driving tool 10, the working fluid above the piston 26 will flow through the fluid inlet ports 62 into the return air chamber 60, and will thereafter flow through the fluid outlet ports 64 below the piston 26 to drive the piston 26 back through its return stroke. The fluid pressure drop should be less through the port beneath the piston than above, otherwise it will not be displaced sufficiently, blocking ports 62 and allowing the full return stroke. A greater volume of fluid will exit from chamber 60 to the bottom of the driver thus shifting it upwardly and closing off flow from inlet ports 62 to above the driver and to atmosphere. Residual return fluid below the piston 26 will be dissipated to atmosphere by bleeding through a bleed opening 70 formed between the drive blade 28 and a bumper assembly 72 (air also allowed to escape passed the piston seal through gaps in the upper-most section of the sleeve). The bumper assembly 72 includes at one resilient cushioning member or bumper 74 in the lower end of the cylinder 18. The bumper 74 acts as a stop for the piston 26 when it is at the end of its drive stroke.

The control valve assembly 22 includes a trigger valve 76. The trigger valve 76 includes a trigger 78, which may be depressed to a first position to provide for single actuation of the tool 10, and further depressible to a second position to provide contact actuation of the tool 10 so long as the trigger is held in the depressed position.

Figure 3:
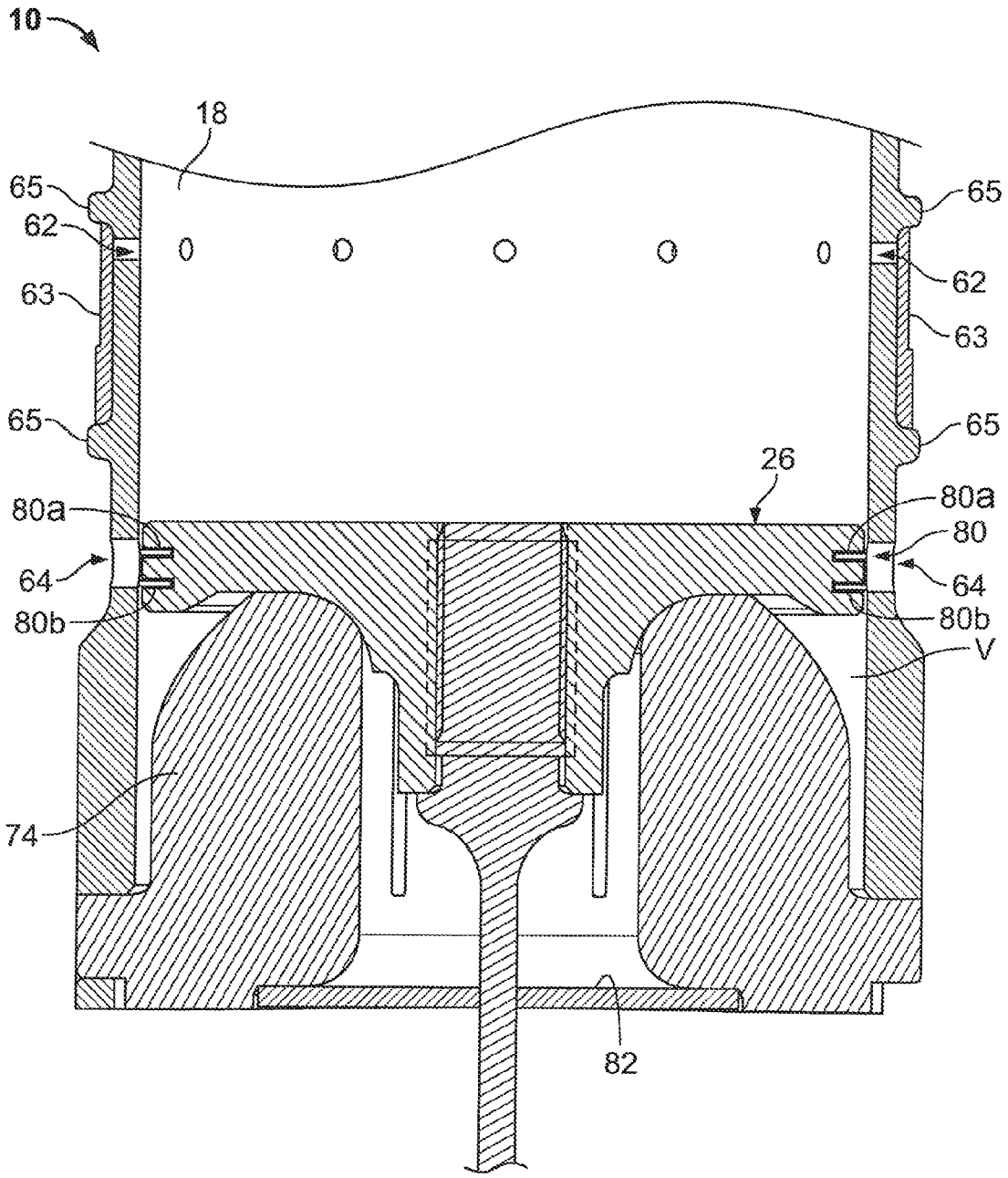
FIG. 3 is a fragmentary vertical section of the present pneumatic fastening tool provided with outlet ports adjacent the point where the piston engages the bumper.

Referring now to FIG. 3, an important feature of the present fastener driving tool 10 is that at least one, and preferably a plurality of the outlet ports 64 defined by the cylinder 18, are placed generally coplanar with, or in alignment with the piston 26 when it reaches the bottom of its travel and strikes the bumper 74. Thus, as the piston 26 passes the inlet ports 62, some of the back pressure (pressure of the compressed air under the piston) is released to the return air chamber 60 (FIG. 2) through the outlet ports 64. However, as the piston 26 impacts the bumper 74, the piston temporarily closes, and preferably, seals the outlet ports 64, thus trapping a residual amount of air in a volume 'V' below the piston 26 to provide a damping effect. The compressed damping volume 'V' is sufficient to damp the impact of the piston 26 upon the bumper 74, and is considered sufficient to prevent premature tool failure due to impact forces generated from repeated reciprocal impact of the piston on the bumper.

In the preferred embodiment, the outlet ports 64 are provided in a spaced array around the cylinder 18 at the point where the piston 26 impacts the bumper 74. The shape of the outlet ports 64 may vary to suit the situation, and are preferably oval. It should be appreciated that the outlet ports 64 may also be rectangular, circular or may be any suitable size or shape. The piston 26 is typically provided with at least one seal ring 80. In an embodiment shown in FIGS. 3-6, the piston 26 includes a pair of seal rings 80 that are made of metal. It should be appreciated that each seal ring 80 may be made of a metal, a polymer, such as an injection molded polymer, or any suitable material or combination of materials.

As the piston 26 moves downward within the cylinder 18, the fluid under the piston 26 moves through the outlet ports 64 and into the return air chamber 60. Additionally, when an upper piston ring 80*a* moves past the inlet ports, pressurized fluid, which is in the cylinder 18 above the piston 26 and driving the piston downward within the cylinder, flows through the inlet ports and into the return air chamber 60. As stated above, the inlet ports 62 are configured to allow fluid flow in one direction (from the cylinder to the return air chamber) but not in a second, opposite direction (from the return air chamber to the cylinder). As the piston 26, and more specifically, a lower piston ring 80*b* moves past the outlet ports 64, the lower piston ring seals the area of the cylinder below the piston 26 and thereby prevents escape of residual air located between the piston 26 and bottom end 82 of the cylinder. The residual volume of air "V" between the piston 26 and the bottom end 82 of the cylinder 18 has a fluid pressure that increases as the piston compresses the fluid. The pressure of the residual fluid significantly decreases the downward velocity of the piston 26 and lessens the impact of the piston on the bumper 74 thereby limiting the compression of the bumper. By limiting the compression of the bumper, the present fastener driving tool 10 controls the depth of the drive of the tool, i.e., the depth that a fastener penetrates a substrate or workpiece, regardless of the pressure of the incoming fluid source.

For example, in conventional fastener driving tools, if the pressure of fluid, such as air, supplied to the tool is 80 psi, the piston will impact the bumper and compress it a designated amount, which causes the driven fastener to further penetrate an underlying substrate or workpiece by a depth or distance equal to that designated amount. Using air that is at a higher pressure, such as 120 psi, causes the piston 26 to move at a greater downward velocity within the cylinder 18 than the 80 psi fluid. Thus, the impact of the piston 26 on the bumper 74 is greater thereby further compressing the bumper and causing the fastener to be driven into the substrate or workpiece at a depth that is greater than the fastener depth using the air at 80 psi. As a result, the depth of the fasteners driven into a substrate or workpiece using conventional fastener driving tools, and more specifically, conventional pneumatic fastener driving tools varies based on the pressure of the fluid source being used to power the tool.

To overcome the above variable depth of drive problem, the present fastener driving tool 10 seals and retains a residual amount of fluid between the piston 26 and the bottom end 82 of the cylinder 18 to significantly decrease the downward velocity of the piston and thereby reduce the impact of the piston on the bumper 74. Controlling the impact of the piston 18 on the bumper 74, significantly decreases the compression of the bumper thereby decreasing the differences in the drive depths of the fasteners due to the varying pressures of fluid sources. Additionally, lessening the impact of the piston 26 on the bumper 74 reduces the impact shock on the tool 10 which extends the working life of the tool.

Figure 4:
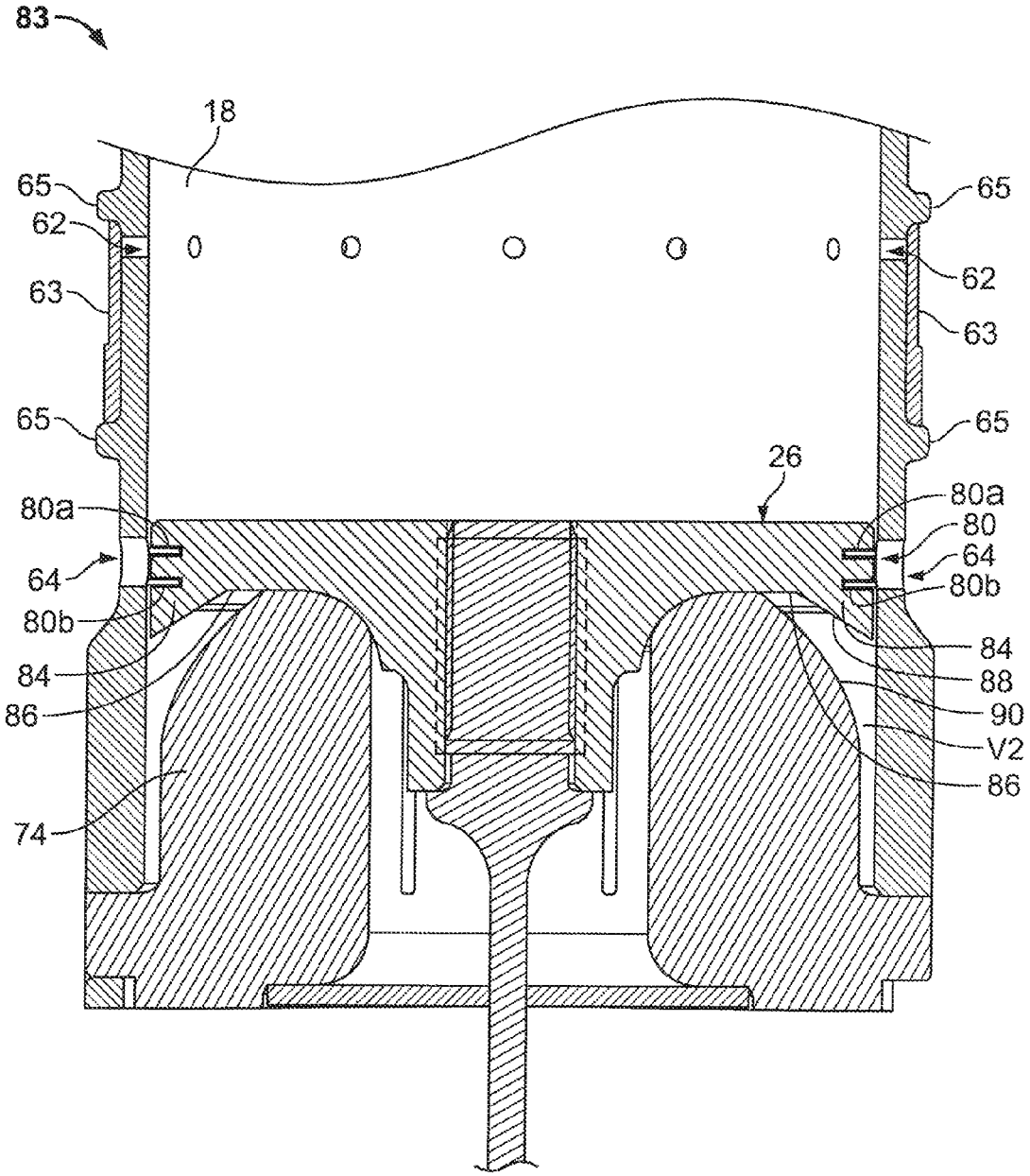
FIG. 4 is a fragmentary vertical section of an alternate embodiment of the present pneumatic fastening tool provided with a modified piston configuration.

Referring now to FIG. 4, an alternate embodiment of the present tool is generally designated 83. Components shared with the tool 10 discussed above are designated with the same reference numbers. The main distinction of the tool 83 is that a piston 26 is provided having an annular damping formation 84 depending from a lower face 86 of the piston. A main purpose of the damping formation 84 is to reduce the volume 'V' and accordingly generate increased damping action. As such, the specific shape of the formation 84 may change to suit the situation. However, it is preferred that the damping formation 84 is provided with an angled leading edge 88 configured to complement the opposing profile 90 of the bumper 74.

As shown in FIG. 4, as the piston 26 reaches its lowest travel limit, the compressed volume 'V2' is reduced compared to the volume 'V' (FIG. 3), thus increasing the pressure and the damping action. Also, it will be seen that a lower seal ring 80*b* on the piston 26 is engaged with the cylinder 18, sealing the volume 'V2' from the return air chamber 60 (FIG. 2).

Figure 5:
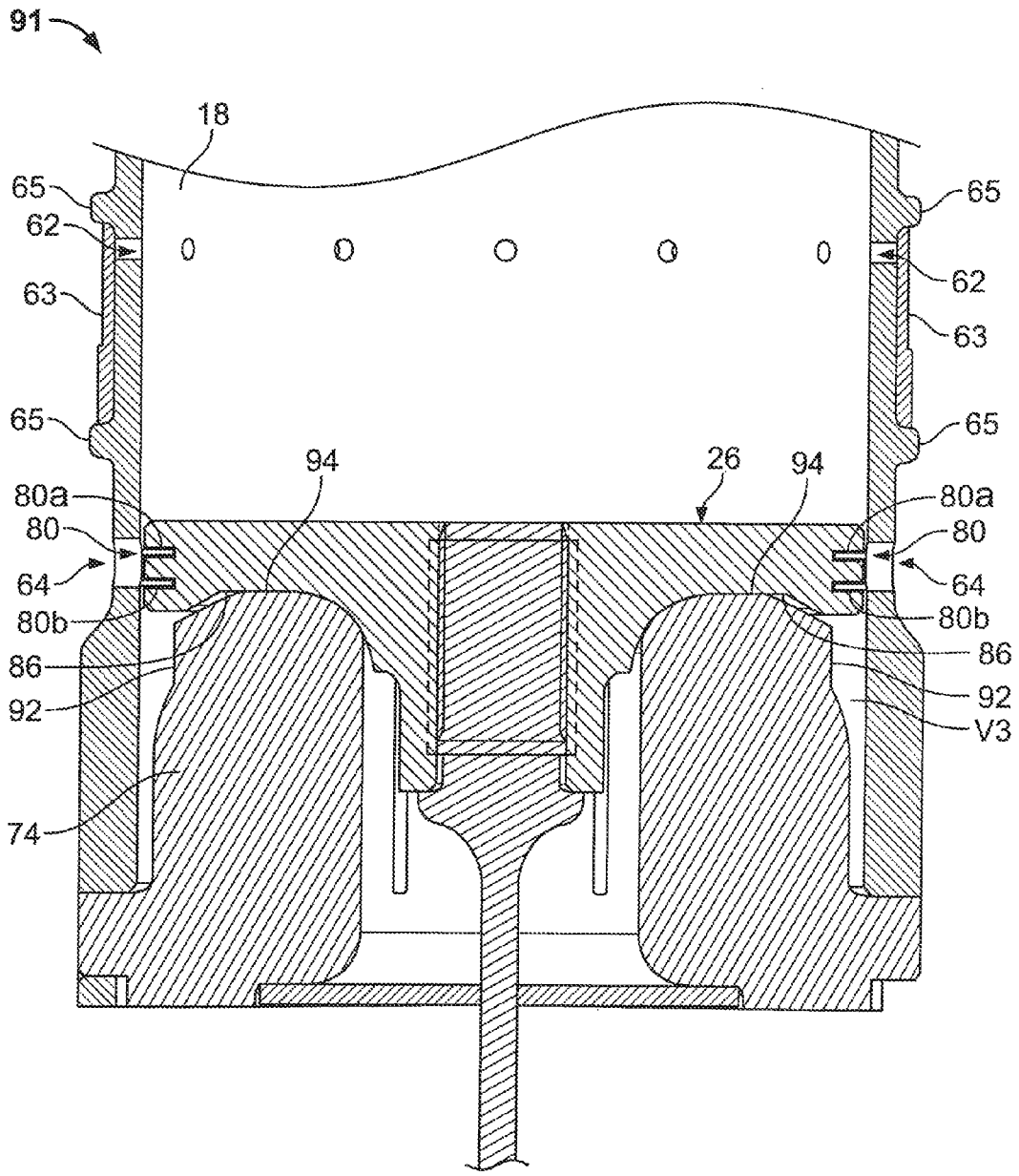
FIG. 5 is a fragmentary vertical section of another alternate embodiment of the present pneumatic fastening tool provided with a modified bumper.

Referring now to FIG. 5, another alternate embodiment of the present tool is generally designated 91. Components shared with the embodiments 10 and 83 discussed above are designated with identical reference numbers. The main distinction of the tool 91 is that a bumper 74 is provided having an increased volume compared to conventional bumpers. More specifically, an outer profile 92 of the bumper 74 defines a general normal or right angle profile along an upper exterior edge that increases the overall profile of the bumper over the profile of conventional bumpers. Also, an upper edge 94 is generally parallel with the opposing piston lower face 86. As is the case with the tool 83 (FIG. 4), this enlarged bumper profile 92 decreases the trapped volume below the piston 26, creating a volume 'V3' that has a higher compression and provides increased damping force. In view of the embodiments 83 and 91, it will be understood that the volume 'V' can be reduced by increasing piston profile, bumper profile, or combinations of the two.

Figure 6:
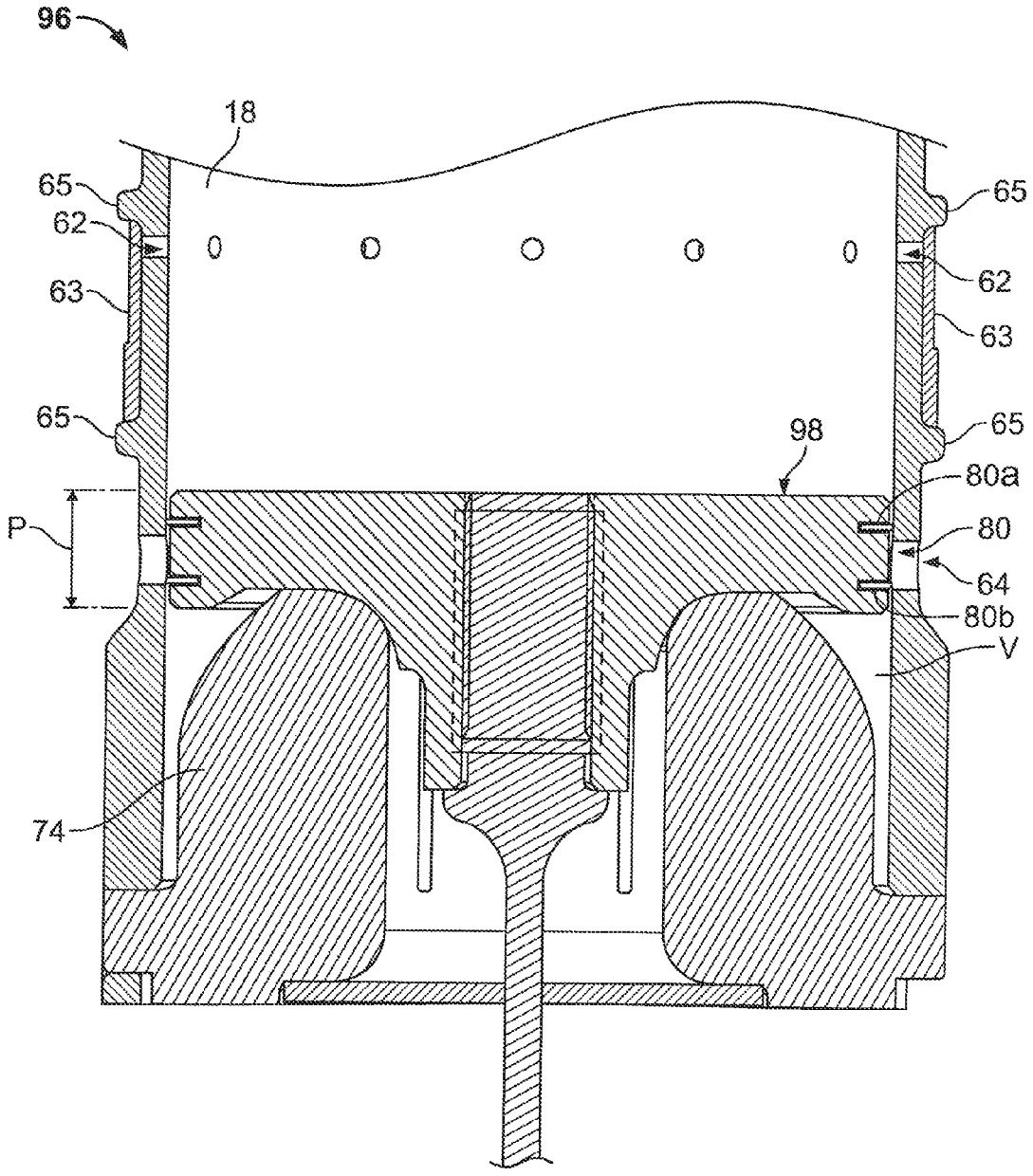
FIG. 6 is a fragmentary vertical section of still another alternate embodiment of the present pneumatic fastening tool provided with a modified piston.

Referring now to FIG. 6, it will be seen that as the piston 26 passes the outlet ports 64, the lower piston seal ring 80*b* is in sealing contact with the cylinder 18, however the upper piston seal ring 80*a* has passed an upper edge of the outlet ports, and as such has allowed the cylinder above the piston to be exposed to ambient. While only a temporary condition, in some cases such exposure may interfere with the creation and maintenance of the fluid pressure above the piston 26 and the residual volume of fluid sealed under the piston to ensure sufficient damping of the piston and the return of the piston to its initial position after a drive stroke.

To maintain a sealing relationship above and below the piston as the piston impacts the bumper 74, an alternate embodiment of the present tool is provided and is generally designated 96. In the embodiment of tool 96, components shared with the previous embodiments are designated with identical reference numbers. A main distinction of the tool 96 is that a piston 98 is provided with an increased thickness or height "P". While the piston 98 depicted is somewhat exaggerated for purposes of explanation, the height "P" is sufficient to maintain a sealing relationship between the upper piston seal ring 80*a* and the cylinder 18 during the travel cycle of the piston, regardless of whether it is against or away from the bumper 74 in the vicinity of the outlet ports 64. As such, it will be appreciated that the height "P" of the piston 96 may vary to suit the application, provided the sealing relationship is maintained between the upper seal ring 80*a* and the cylinder 18 at an upper margin of the outlet ports 64. As shown in FIG. 6, the piston 96 has just contacted the bumper 74 and as such has not compressed the bumper, and the lower piston ring 80*b* seals the volume 'V' as it progresses past the outlet ports 64 to reach and seal a lower margin of the outlet ports as seen in FIG. 3. Once the volume V is sealed to create the residual volume under the piston 96 and the vacuum is maintained above the piston 96, the piston returns to the top of the cylinder.

While a particular embodiment of a pneumatic-powered fastener-driving tool has been described herein, it will be appreciated by those skilled in the art that changes and modifications may be made thereto without departing from the invention in its broader aspects and as set forth in the following claims.

The invention claimed is:

1. A fastener driving tool comprising:

a housing enclosing a cylinder and defining a return air chamber in fluid communication with said cylinder;

a resilient bumper in said cylinder;

a piston slidably received within said cylinder and movable between a rest position and a drive position in which said cylinder contacts said bumper, said piston having a driver blade depending therefrom;

at least one inlet opening disposed in a wall of said cylinder and in fluid communication with said return air chamber;

a band at least partially surrounding the cylinder, the band including an elastomeric material and defining a closeable opening that is aligned with the at least one inlet opening, the closeable opening configured such that fluid can flow from the cylinder to the return air chamber via the closeable opening but cannot flow from the return air chamber to the cylinder via the closeable opening; and at least one outlet opening disposed in said wall of said cylinder and spaced from said at least one inlet opening, each said at least one outlet opening being in fluid communication with said return air chamber and aligned with and closed by said piston to seal an area of said cylinder below said piston when said piston impacts said bumper, wherein said at least one outlet opening is positioned on said cylinder such that upon said piston impacting said bumper and closing each said at least one outlet opening and sealing said area, a residual volume of air is trapped in said area below said piston to damp impact of said piston upon said bumper.

2. The tool of claim 1 further including a plurality of said inlet openings spaced about said cylinder.

3. The tool of claim 1 further including a plurality of said outlet openings spaced about said cylinder.

4. The tool of claim 1, wherein said piston includes at least one seal ring that forms a seal between said piston and said cylinder.

5. The tool of claim 4, wherein said at least one seal ring is made with a metal or a polymer.

6. The tool of claim 1, wherein said piston includes two spaced seal rings each forming a seal between said piston and said cylinder.

7. The tool of claim 1 further including a damping formation extending from a lower side of said piston.

8. The tool of claim 1, wherein said piston has a height that is greater than a height of said at least one outlet opening.

9. A fastener driving tool comprising:

a housing enclosing a cylinder and defining a return air chamber in fluid communication with said cylinder;

a resilient bumper in said cylinder;

a piston dimensioned for reciprocation within said cylinder and having a driver blade depending therefrom and a pair of spaced seal rings;

a plurality of inlet openings defined by a wall of said cylinder, each of said inlet openings being in fluid communication with said return air chamber; and a plurality of first outlet openings defined by the wall of said cylinder and spaced from said plurality of inlet openings and a second, bottom outlet opening between said driver blade and said bumper, the second, bottom outlet opening not being one of the plurality of first outlet openings, said plurality of first outlet openings being in fluid communication with said return air chamber, said plurality of first outlet openings each having a height approximately less than or equal to a height of said piston, said piston being aligned with and configured to block each of said plurality of first outlet openings to seal an area of said cylinder below said piston and between said bumper and said cylinder when said piston impacts said bumper and retain a residual volume of air in said area for providing damping to said piston, said plurality of first outlet openings each having a height less than or equal to a distance between said rings so that at least one of an upper seal ring seals an upper margin of each of said plurality of first outlet openings, and a lower seal ring seals a lower margin of each of said plurality of first outlet openings when said piston impacts said bumper.

10. The tool of claim 9 wherein each of said plurality of inlet and outlet openings are disposed along a periphery of said cylinder.

11. The tool of claim 9 further including a damping formation depending from a lower side of said piston which complements an opposing profile of said bumper.

12. The tool of claim 1, wherein the return air chamber is in fluid communication with the cylinder via the at least one outlet opening after the piston begins moving toward the bumper and before the piston closes each said at least one outlet opening.

13. The tool of claim 9, wherein the return air chamber is in fluid communication with the cylinder via the plurality of first outlet openings after the piston begins moving toward the bumper and before the piston blocks each of the plurality of first outlet openings.

* * * * *